US005460073A

United States Patent [19]

Preston et al.

[11] Patent Number: 5,460,073

[45] Date of Patent: Oct. 24, 1995

[54] METHOD AND APPARATUS FOR FEEDING HOSES INTO MINING BOREHOLES AND THE LIKE

[75] Inventors: Chris Preston, North Bay; Gary Rezansoff, Garson; Michael Filion, Val Caron, all of Canada

[73] Assignee: Dyno Nobel Inc., Salt Lake City, Utah

[21] Appl. No.: 143,699

[22] Filed: Oct. 27, 1993

[51] Int. Cl.[6] ..... C06D 1/08

[52] U.S. Cl. ..... 86/20.15

[58] Field of Search ..... 86/20.15

[56] References Cited

U.S. PATENT DOCUMENTS

| | | | |
|---|---|---|---|
| 3,361,023 | 1/1968 | Collins et al. | 86/20.15 X |
| 4,040,355 | 8/1977 | Hopler, Jr. | 86/20.15 X |
| 4,051,988 | 10/1977 | Egerstrom et al. | 86/20.15 X |
| 4,508,035 | 4/1985 | Mashimo et al. | 102/313 |

*Primary Examiner*—Peter A. Nelson
*Attorney, Agent, or Firm*—Thorpe North & Western

[57] ABSTRACT

A method and apparatus are described for feeding a hose having a corrugated exterior surface into a mining borehole and the like. The apparatus includes a support frame and a rotatable drive wheel having an annular groove for receiving the hose and ridges extending therefrom for meshing with the corrugated surface of the hose. An idler wheel having an annular groove for receiving the hose is disposed on the support frame to bias the hose against the drive wheel. A reversible, variable speed motor coupled to the drive wheel is provided for causing the drive wheel to rotate in a selectable direction and at a selectable speed. The apparatus is mountable on an implement used in a mining operation. The hose is couplable to a source of liquid explosive and to an inflatable wand for charging boreholes with explosive.

21 Claims, 5 Drawing Sheets

METHOD AND APPARATUS FOR FEEDING HOSES INTO MINING BOREHOLES AND THE LIKE

BACKGROUND OF THE INVENTION

This invention relates to methods devices used for feeding hoses into boreholes as part of a mining operation. More particularly, the present invention relates to a method and apparatus for feeding a hose, such as a hose that is used for charging mining boreholes with liquid explosive, into generally upwardly oriented boreholes.

The success of underground mineral mining operations depends on efficient procedures for fracturing rock and extracting ore. One form of fracturing operation is known as sublevel caving and involves fracturing overhead rock formations in a controlled manner. A complete and continuous fracturing process is important to maximize ore recovery and avoid the high risk of unexpected collapse of overhead rock structure into the sublevel cave area.

The required systematic fracturing of rock structure is accomplished in part by drilling a set of substantially upright, overhead boreholes which are loaded with explosive material. These boreholes have diameters ranging from about 5.4 cm to about 11.4 cm and may be drilled in a fan pattern, in a ring pattern, in parallel orientation, or combinations thereof, depending on the desired pattern of collapse of superior rock structure.

Boreholes drilled in a ring pattern are not drilled equal distances from each other, primarily because of the configuration of the drill itself. A drill is set up at a fixed position in the working stope with the drill arm allowed to rotate to drill a ring. A typical ring is comprised of a set of boreholes drilled at angles up to 20 degrees about the axis of the drill arm. These blastholes are drilled in a fan-shaped pattern with as little as about 15 cm distance separating them at the drill bit entry points. Holes up to about 30 m long can be drilled with a typical separation at the toe of the hole of about 3.5 m.

When the ring of boreholes is loaded with explosives, typically by pumping a liquid explosive into upwardly oriented boreholes, there is a concentration of explosive material in the collar region due to the short distance between each hole in the ring because of the fan pattern. It would be desirable to have from about 4.5 to 14 m of non-loaded borehole, or collar, to avoid excessively high powder factors in the collar region. High powder factors tend to damage adjacent rings and can contribute to poor explosive loading conditions due to excessive cracking of the rock structure into other drilled holes.

Thus, it would be desirable to selectively adjust the collar in upwardly oriented boreholes loaded with liquid explosive. This selectivity would facilitate obtaining the proper collar required for specific rock conditions encountered in a particular mining operation. Advantages of this selectivity would include cost savings because of less liquid explosive used, increased safety by lowering the powder factor in the collar region of drilled holes, better rock fragmentation by avoiding the cratering action produced when borehole collars are loaded with explosive or "collar primed," and preventing cratering action into adjacent rings and thus permitting improved conditions for subsequent blasting operations.

U.S. Pat. No. 4,813,358 to Roberts describes an inflatable wand designed to be positioned within an upwardly oriented borehole. The wand includes a flexible tube for positioning along an elbow or bend in a borehole, a conduit through which liquid explosive may be pumped into the bore hole, and capacity to be inflated to radially expand and seal the opening of the borehole so that the liquid explosive is retained within the borehole. If the inflatable wand could be threaded an appropriate distance up a borehole, the problem of providing adjustable collars would be solved. It is extremely difficult to manually push the wand up into a borehole more than about 1.5 m because the wand becomes very slippery when coated with liquid explosive and is heavy due to the combined weight of the wand and liquid explosive.

OBJECTS AND SUMMARY OF THE INVENTION

It is an object of the present invention to provide a method and apparatus for feeding hoses into boreholes.

It is another object of the invention to provide a method and apparatus for feeding an inflatable wand and associated hose a selectable distance into a borehole.

It is a further object of the invention to avoid high powder factors in the collar region of boreholes by providing a method and apparatus for selectively adjusting the length of borehole collars.

Still another object of the invention is to increase safety of an underground mining operation by providing a method and apparatus for avoiding high powder factors in the collar region of boreholes.

Yet another object of the invention is to provide a method and apparatus for selectively adjusting collars of boreholes according to rock conditions encountered in a particular blasting operation.

Another object of the invention is to provide a method and apparatus for yielding improved rock fragmentation in underground blasting operations.

A still further object of the invention is to provide a method and apparatus for avoiding cratering action of underground blasting procedures and thus improve conditions for later blasting operations.

These and other objects may be realized by a method and apparatus for feeding a hose having a corrugated exterior surface into a mining borehole and the like. The apparatus includes a rotatable drive wheel having an annular groove and a plurality of ridges extending radially from the drive wheel. The annular groove is adapted for receiving the hose, and the ridges are adapted for meshing with the corrugated surface of the hose. The apparatus also includes mechanisms for biasing the hose against the drive wheel and for rotating the drive wheel. The drive wheel, the biasing mechanism, and the mechanism for rotating the drive wheel are all disposed on a support frame.

Another aspect of the invention includes the use of a rotatable idler wheel as the mechanism for biasing the hose against the drive wheel. The idler wheel has an annular groove adapted for receiving the hose. The tension of the idler wheel against the drive wheel may be adjustable by means of a screw or spring mechanism.

A further aspect of the invention is the use of a reversible, variable speed motor for causing the drive wheel to rotate. A preferred embodiment of such a motor is a hydrostatic drive motor.

Still another aspect of the invention is the provision of a hose having a corrugated surface to mesh with the ridges extending from the drive wheel. The corrugated surface may be formed by wrapping a wire in a spiral pattern around a smooth interior layer of the hose. A protective layer of nylon or other polymer may be interposed between the interior layer and the wire. An exterior layer of rubber or other material circumscribes the interior layer, protective layer, and wire. One end of the hose is couplable to a source of explosive material and the other end is couplable to a wand having a conduit for conducting the explosive material into the borehole or the like. The wand advantageously includes an inflatable portion for receiving a compressed gas and expanding to seal the borehole while the explosive material is deposited.

Figure 4A:
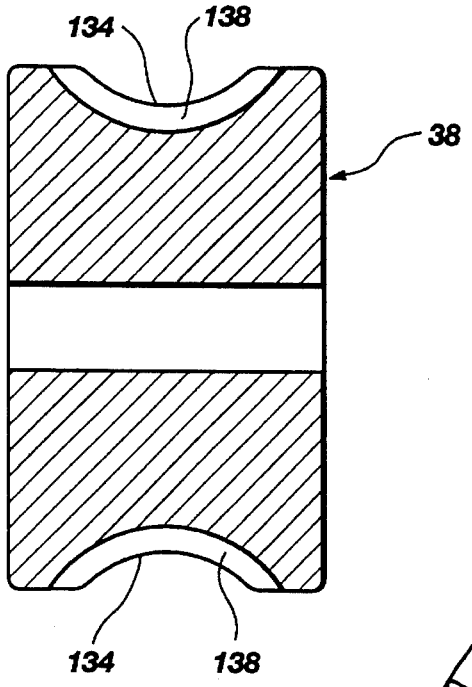
FIG. 4A is a radial section view of the drive wheel of FIG. 3.

FIB. 4B is a cross section view of the drive wheel of FIG. 4A.

Figure 2:
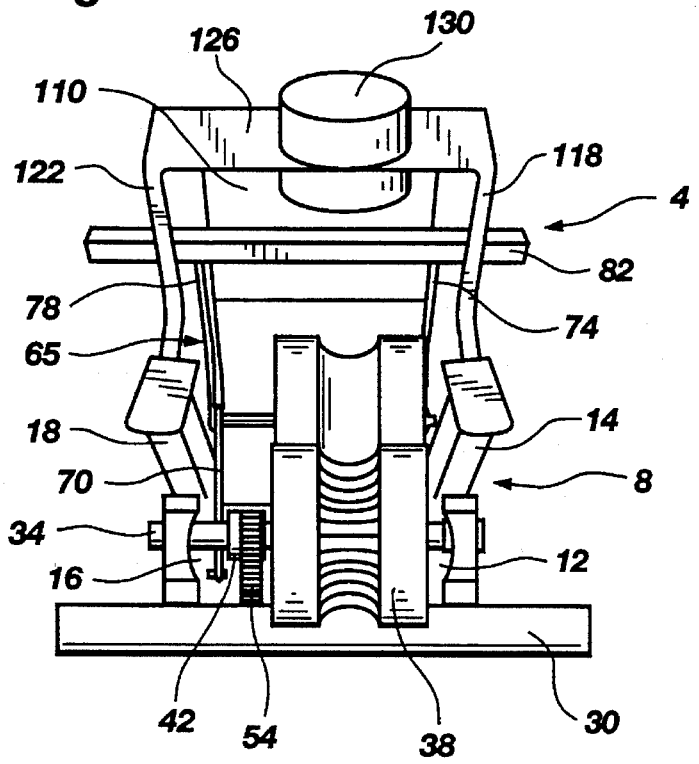
FIG. 2 is a front, perspective view of the apparatus of FIG. 1.
Figure 5:
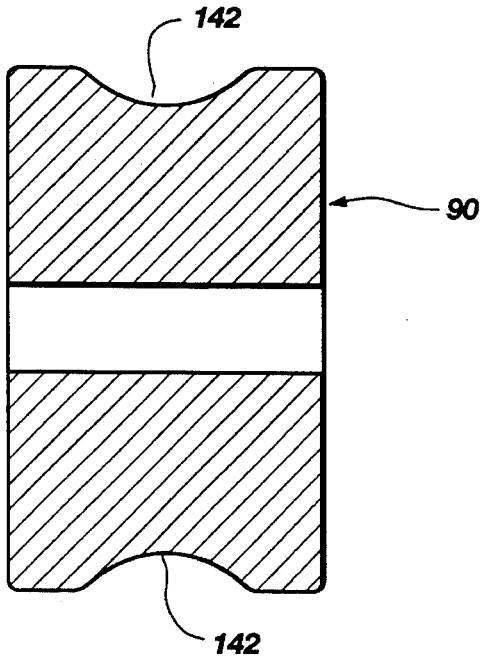

FIG. 5 is a radial section view of the idler wheel of FIG. 2.

Figure 6:
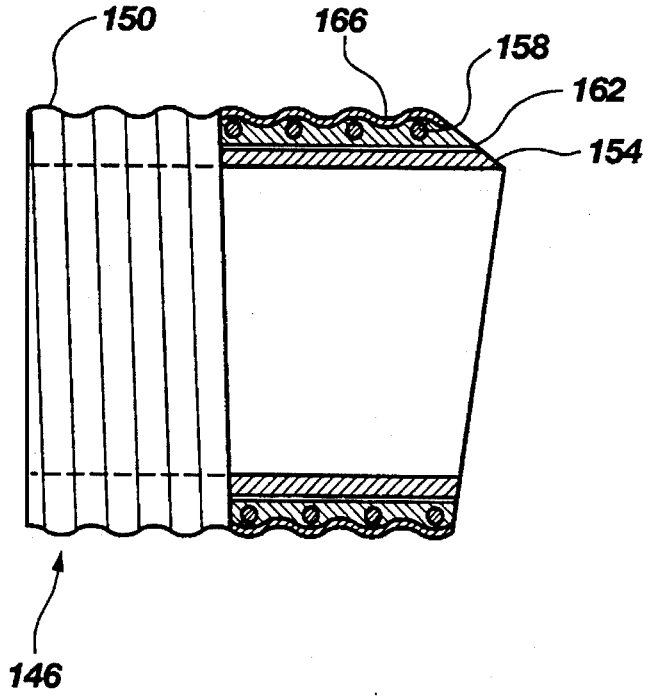

FIG. 6 is a partial side view, partial longitudinal section view of a corrugated hose in accordance with the present invention.

Figure 7:
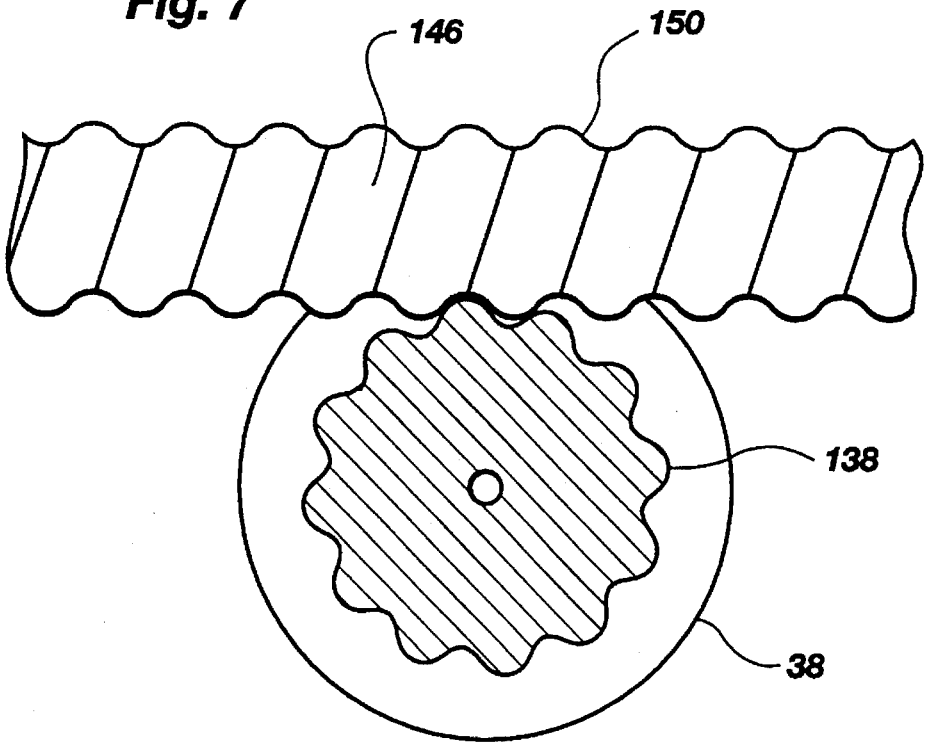

FIG. 7 is a side, cross-sectional view of a drive wheel of the present invention, showing the ridges in mesh with the corrugated hose in accordance with the present invention.

Figure 8:
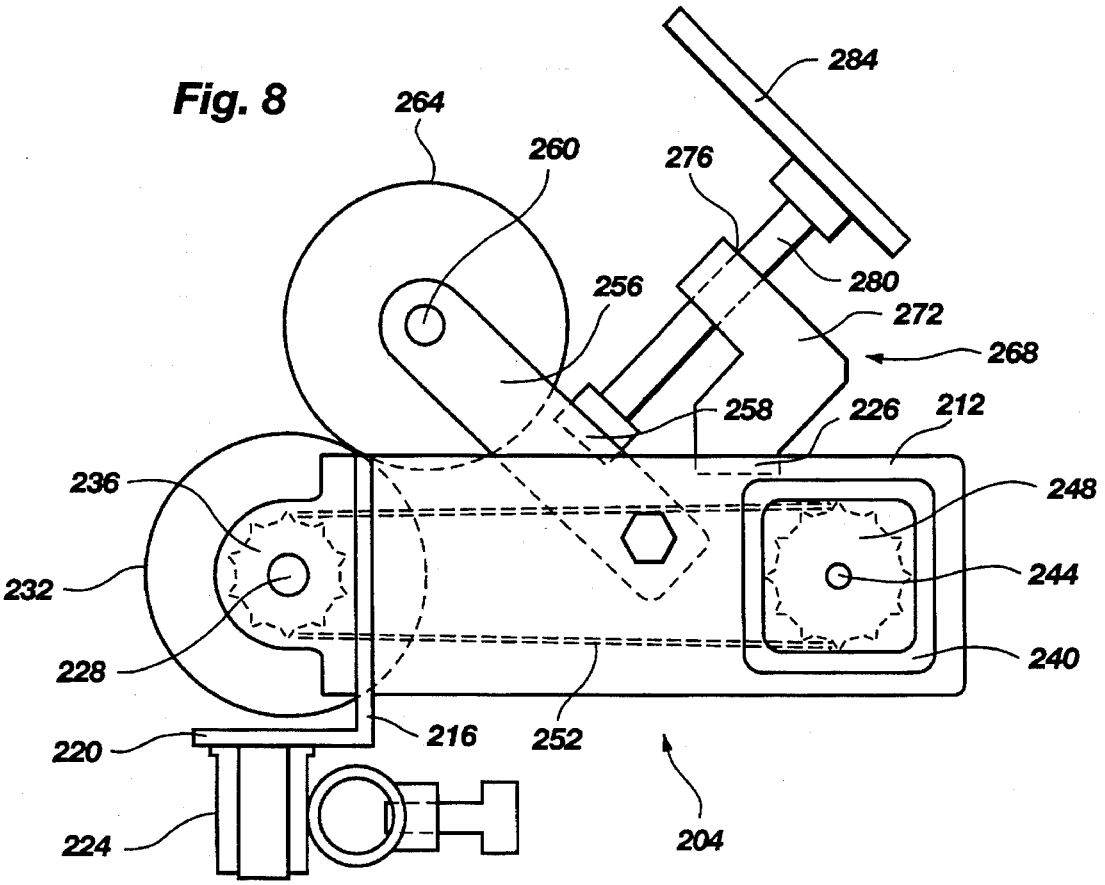

FIG. 8 is a side view of another embodiment of an apparatus for feeding a hose into boreholes and the like, in accordance with the present invention.

DETAILED DESCRIPTION OF THE INVENTION

Before the present apparatus for feeding hoses into mining boreholes is disclosed and described, it is to be understood that this invention is not limited to the particular embodiments and materials disclosed herein as such embodiments and materials may vary somewhat. It is also to be understood that the terminology used herein is used for the purpose of describing particular embodiments only and is not intended to be limiting since the scope of the present invention will be limited only by the appended claims and their equivalents.

Figure 1:
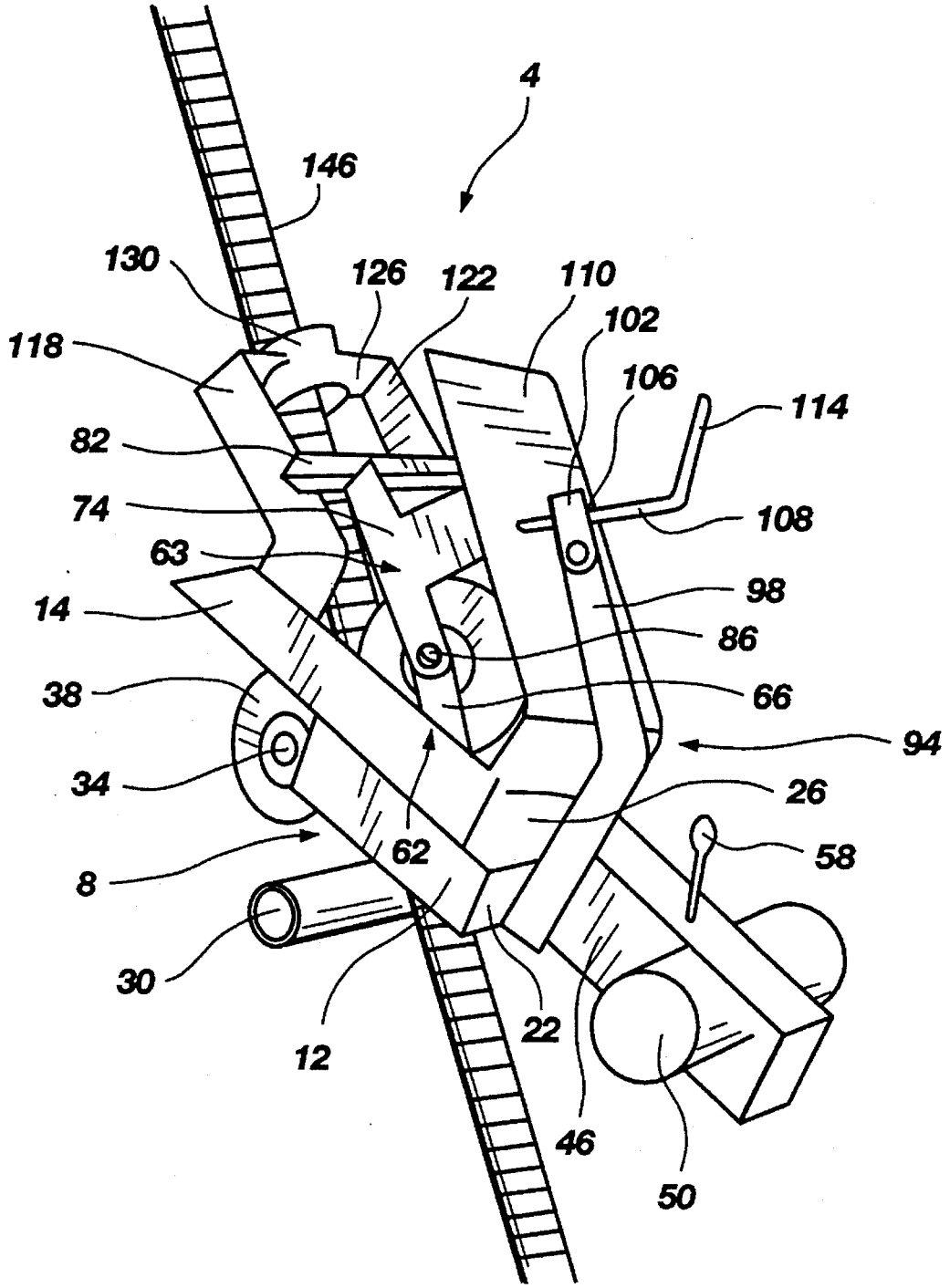
FIG. 1 is side perspective view of one embodiment of an apparatus for feeding a hose into a mining borehole and the like, in accordance with the present invention.

Referring to FIGS. 1–2 there is shown an apparatus 4 for feeding a hose into a mining borehole or the like. The apparatus 4 consists of two grooved rollers and associated components. The rollers are supported by a support frame 8 consisting of four generally parallel arms, only two of which (arms 12 and 14) are shown in FIG. 1. All four arms 12, 14, 16, and 18 are shown in FIG. 2. Arm 14 is mounted on arm 12, and arm 18 is mounted on arm 16. Arms 12 and 16 are interconnected by cross piece 22, and arms 14 and 18 are interconnected by cross piece 26. Arms 12 and 16 are also disposed on a mounting device such as a pipe 30. By means of this mounting device or pipe 30 the apparatus 4 is couplable to a support member such as a manbasket, scissor lift, boom, explosives cart, or the like. The pipe 30 is slidable onto a bar or similar member for mounting on the support member, so that the apparatus 4 is rotatable in the vertical plane. Other means known in the art, such as a double swivel, for coupling the apparatus 4 to a support member are contemplated as within the scope of the invention.

Figure 3:
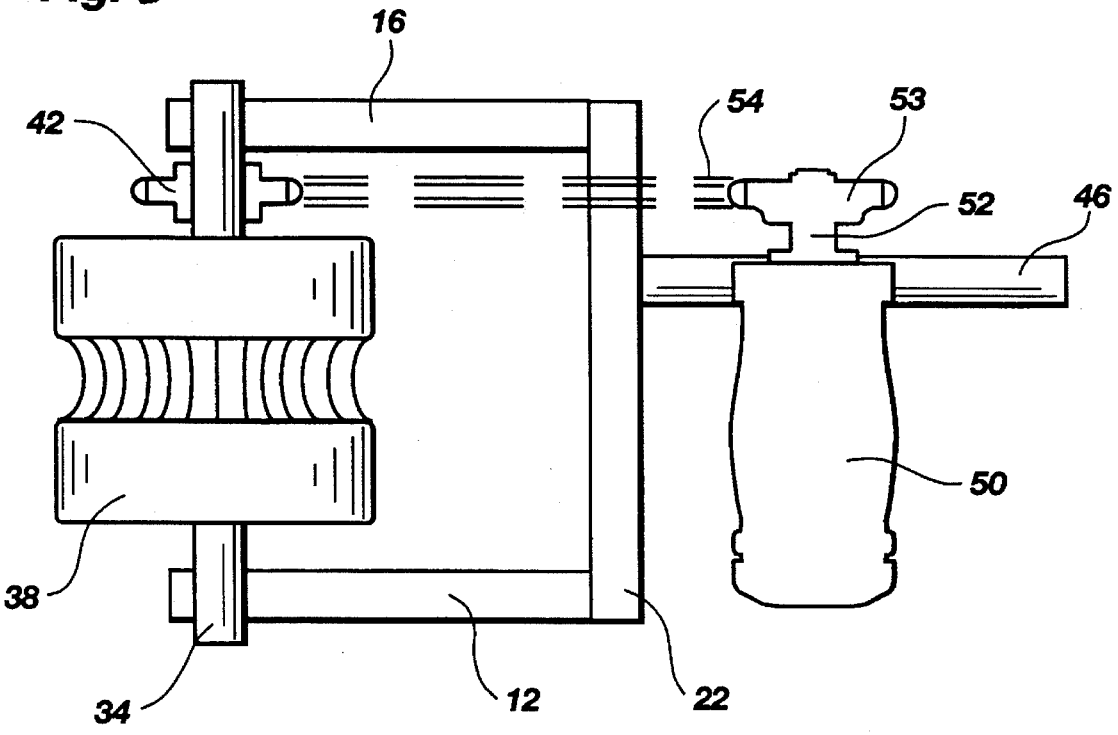
FIG. 3 is a top view of the drive wheel and associated support frame and drive motor of the apparatus of FIG. 1.

Still referring to FIGS. 1–2, a shaft 34 is rotatably mounted between arms 12 and 16 upon which is fixedly disposed a grooved drive wheel 38, which will be described in more detail momentarily. This drive wheel 38 may be keyed or otherwise fixed to the shaft 34. Also mounted on the shaft 34 is a driven gear 42. Extending rearward from cross piece 22 is a motor support member 46 upon which is mounted a hydrostatic drive motor 50. Preferably, the drive motor 50 is a reversible variable speed motor. Reversibility provides the flexibility to insert the hose into a borehole as well as withdraw it again after the borehole has been charged with explosive material. The variable speed capability provides the flexibility to insert or withdraw the hose according to the conditions encountered in a particular borehole. As shown is FIG. 3, fixedly attached to the output shaft 52 of the motor 50 is a drive gear 53. A steel drive chain 54 is looped around and connects the driven gear 42 and the drive gear 53. Thus, when the output shaft 52 of the motor 50 is caused to rotate, the drive gear 53 rotates, causing the driven gear 42, shaft 34, and drive wheel 38 to rotate. The speed of rotation of the output shaft 52 of the motor 50 is controlled by a control valve mounted on the motor support member 46. The valve is operated manually by means of a control handle 58 (FIG. 1).

Referring again to FIGS. 1–2, also mounted on the support frame 8 is an idler wheel assembly 62 consisting of two idler arm assemblies 63 and 65, each having a link 66 and 70 pivotally connected to support frame 8 and idler arm 74 and 78. One end of each link 66 and 70 is pivotally disposed on the support frame 8 so that the idler wheel assembly 62 may pivot in the vertical plane with respect to the support frame 8. Disposed on the other ends of links 66 and 70 are, respectively, idler arms 74 and 78, which are interconnected by cross piece 82. Rotatable shaft 86, on which is mounted a grooved idler wheel 90, is rotatably disposed to interconnect idler arm assemblies 63 and 65.

Pivoting of the idler wheel assembly 62 with respect to the support frame 8 is controlled by an idler pressure assembly 94 consisting of a bracket 98 attached to cross piece 22 and motor support member 46. Bracket 98 has pivotally attached at one end a screw link 102 containing a threaded opening 106 through which extends a threaded bar 108 such that the threads on the bar 108 are in mesh with the threads in the opening 106 of the screw link 102. One end of the bar 108 is disposed on sheet 110 which is permitted to rest against protrusions on idler arms 74 and 78. The other end of the bar 108 consists of a handle 114 for manually rotating the bar 108. By rotating the handle 114 and bar 108, pressure on sheet 110 is adjusted. Pressure on sheet 110, in turn controls the pressure on the idler wheel assembly 62. Other means of adjusting the pressure on the idler wheel assembly 62, such as a spring mechanism, are contemplated as within the scope of the invention.

The apparatus 4 also contains a mechanism for guiding a hose being inserted in a borehole toward the borehole. In FIGS. 1–2 are shown guide arms 118 and 122, each attached at one end to an arm (arms 14 and 18, respectively) of the support frame 8 and interconnected by cross piece 126. Cross piece 126 supports a section of pipe 130 through which the hose feeds.

Figure 4B:
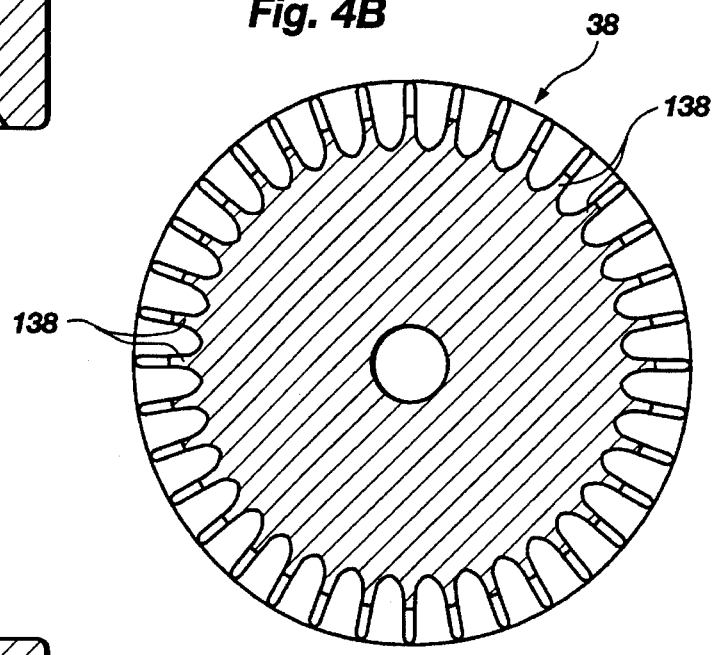

FIGS. 4A and 4B show a drive wheel 38 suitable for use in accordance with the present invention. Around the circumference of the drive wheel 38 is an annular groove 134 with a radius adapted to the outside curvature of a hose. Extending from the drive wheel 38 in the area of the annular groove 134 is a regular array of teeth or ridges 138 designed to fit in meshing relationship with corrugations on the outer surface of a hose, which will be described momentarily. FIG. 5 shows an idler wheel 90 in accordance with the present invention. The idler wheel 90 also contains an annular groove 142 having a radius adapted to the outside curvature of a hose. When the drive wheel 38 and idler wheel 90 are brought into close proximity with their grooves 134 and 142 aligned, a space is created through which a hose may extend. By rotating the handle 114 of the idler pressure assembly 94, the idler wheel 90 is biased against the hose to help maintain the hose in its proper location in the space between the grooves 134 and 142 of the drive wheel 38 and idler wheel 90, and to bias the corrugations of the hose against the teeth or ridges 138 of the drive wheel 38.

FIG. 6 shows a hose 146 adapted for use with the present invention. The hose 146 has a corrugated or "threaded" exterior surface 150. This corrugated exterior surface 150 results from wrapping the smooth interior layer 154 of the hose 146 with a steel band or wire 158 in a spiral manner. Advantageously, a layer of nylon reinforcement 162 may cover the interior layer 154 before wrapping with the steel wire 158. Exterior to the spiral-wrapped steel wire 158 is a cover layer 166. As an illustrative embodiment of the hose 146, the inside diameter is about 5 cm and the outside diameter is about 7.1 cm. Preferably, the outside diameter of the hose will be in the range of about 1.6 to 7.5 cm, more preferably in the range of about 5.1 to 7.1 cm. The hose 146 is designed so that the usual internal pressure is about 20.7 MPa. The diameter of the steel wire 158 is about 2.5 mm and the thickness of the cover layer 166 is also about 2.5 mm. The corrugations have a height of about 3.8 mm. The steel wire 158 is wrapped to give about 85 to 120 revolutions per meter of hose 146. The interior layer 154 and cover layer 166 may be made of any suitable materials, such as rubber. This type of hose 146 can be indexed to the drive wheel 38 such that the hose 146 can be driven by a "rack and pinion" arrangement, FIG. 7. The corrugated surface 150 of the hose 146 functions as a rack gear and the drive wheel 38, with its ridges 138 in meshing relationship with the corrugated surface 150 of the hose 146, functions as a pinion gear. Rotating the drive wheel 38 causes the hose 146 to be pushed along its longitudinal axis. Rotating the drive wheel 38 in one direction causes the hose 146 to feed away from the apparatus 4, while rotating the drive wheel 38 in the opposite direction causes the hose 146 to be retrieved.

Another embodiment of the invention is shown in FIG. 8. The apparatus 204 consists of two support arms, only one of which (arm 212) is shown. Each support arm is mounted on a generally vertical leg, such as is shown with arm 212 and leg 216. These legs are connected by a cross piece 220, which is mounted on a double swivel 224. Another cross piece 226, is mounted between the two support arms. A rotatable shaft 228 is also disposed between the two support arms. Upon shaft 228 are fixedly disposed a drive wheel 232 having an annular groove, and a driven gear 236. Drive wheel 232 has ridges extending therefrom in the annular groove area, similar to the drive wheels pictured in FIGS. 2, 4A, and 4B. These ridges are adapted to mesh with a hose having a corrugated exterior, as shown in FIGS. 1 and 6. Support arm 212 also supports a reversible variable speed motor 240. Mounted on the output shaft 244 of the motor 240 is a drive gear 248 which is connected to the driven gear 236 associated with drive wheel 232 with a chain 252.

Two idler arms (only idler arm 256 is shown disposed on arm 212) are pivotally mounted on the support arms. The idler arms are connected by a cross piece 258. A rotatable idler shaft 260 is mounted between the two idler arms (see arm 256 in FIG. 8), upon which is disposed an idler wheel 264 having an annular groove. When the annular grooves of drive wheel 232 and idler wheel 264 are aligned and place in close proximity to each other, a space is created between the wheels 232 and 264 through which a corrugated hose, similar to that shown in FIG. 6, may extend.

An idler pressure assembly 268 is provided to maintain the pressure of the idler wheel 264 against the hose so that the corrugations on the hose remain engaged with the ridges on the drive wheel 232. Idler pressure assembly consists of a bracket 272 mounted on cross piece 226. A threaded opening 276 passes through a portion of the bracket 272, through which a threaded bar 280 extends. The threads on the bar 280 are in meshing relationship with the threads in the opening 276. The bar includes a handle 284 at one end so that the bar 280 may be rotated manually with respect to the bracket 272. The other end of the bar 280 is disposed against the cross piece 258 that connects the idler arms (only idler arm 256 is shown). Pressure against the cross piece may be increased or decreased by turning the handle 284 either one way or the other.

In operation, referring again to FIGS. 1–2, the apparatus 4 is mounted on a manbasket, scissor lift, boom, explosives cart, or other convenient implement used in an underground mining operation. The hose 146 is inserted into the space between the annular groove 134 in the drive wheel 38 and the annular groove 142 in the idler wheel 90. One end of the hose 146 is connected to a source of liquid explosive, including a pump for forcing the explosive from the source to the place where the explosive is to be deposited. The other end of the hose 146 is connected to an inflatable wand that includes a conduit for introducing the explosive into boreholes. The wand is positioned to be inserted into a borehole. The wand may be positioned either manually or with the aid of a boom operated by remote control or the like. Then the drive wheel 38 is rotated in the direction that causes the hose 146 to feed away from the apparatus, thereby pushing the wand and the hose 146 into the borehole. Once the wand has been inserted the desired distance into the borehole, rotation of the drive wheel is halted. Liquid explosive is pumped into the borehole and the wand is inflated to prevent the explosive from running out of the borehole. After the proper amount of explosive is charged in the borehole, the wand is deflated and the drive wheel 38 is rotated in the direction that retrieves the hose 146. Upon retrieving the hose 146 and wand, other boreholes may be charged in similar fashion.

We claim:

1. An apparatus for feeding a hose having a corrugated exterior surface into a mining borehole and the like, comprising a hose having a corrugated exterior surface;

a rotatable drive wheel having a circumferential annular groove and a plurality of ridges formed to extend radially in the groove for receiving the hose, said ridges being shaped to mesh with the corrugated surface of the hose to prevent longitudinal slippage of the hose with respect to the annular groove;

means for adjustably biasing the hose against the drive wheel;

means for selectably rotating the drive wheel; and a support frame on which are disposed the drive wheel, biasing means, and rotating means.

2. The apparatus of claim 1 wherein the biasing means comprises an idler wheel having a circumferential annular groove adapted for receiving the hose.

3. The apparatus of claim 2 further including means for adjustably biasing the idler wheel against the hose.

4. The apparatus of claim 3 wherein the means for adjustably biasing the idler wheel against the hose comprises a screw means.

5. The apparatus of claim 3 wherein the means for adjustably biasing the idler wheel against the hose comprises a spring means.

6. The apparatus of claim 1 wherein the means for rotating the drive wheel comprises a variable speed drive means coupled to the drive wheel for rotating the drive wheel at various selectable speeds.

7. The apparatus of claim 6 wherein the variable speed drive means comprises a reversible variable speed drive means for selectively driving the drive wheel in either a forward direction or rearward direction.

8. The apparatus of claim 7 wherein the variable speed drive means comprises a hydrostatic drive motor.

9. The apparatus of claim 1 further comprising means for coupling the apparatus to a mining implement.

10. The apparatus of claim 1 further comprising means for guiding the hose in selectable directions.

11. The apparatus of claim 1 wherein the hose further comprises an interior layer and an exterior layer and the corrugated exterior surface of the hose is formed in a spiral pattern.

12. The apparatus of claim 11 wherein the spiral corrugated exterior surface of the hose is formed by a wire wrapped in a spiral pattern around the interior layer of the hose.

13. The apparatus of claim 12 wherein a protective layer is interposed between the interior layer of the hose and the wire.

14. The apparatus of claim 13 wherein the protective layer is composed of a polymer material.

15. The apparatus of claim 14 wherein the polymer material comprises nylon.

16. The apparatus of claim 11 wherein the hose includes first and second ends, the first end being coupled to a source of explosive material and the second end being coupled to a wand having a conduit for conducting explosive material to a borehole or the like.

17. A method for feeding a hose into a mining borehole and the like, comprising the steps of (a) providing a hose having a corrugated exterior surface;

(b) providing an apparatus for feeding the hose away from the apparatus, wherein the apparatus comprises a drive wheel having a circumferential annular groove adapted for receiving the hose and a plurality of ridges formed to extend radially in the groove, said ridges being shaped to mesh with the corrugated surface of the hose to prevent slippage of the hose with respect to the annular groove, means for biasing the hose against the drive wheel, and means for selectably rotating the drive wheel;

(c) inserting an end of the hose into a collar portion of the borehole;

(d) causing the means for rotating the drive wheel to rotate the drive wheel so that the hose is pushed in a direction away from the apparatus; and (e) guiding the hose into the borehole.

18. The method of claim 17 wherein said hose further comprises an interior layer and an exterior layer, said corrugated surface of said hose comprising a wire wrapped in a spiral fashion around the interior layer of the hose with an optional protective layer of material interposed between the interior layer and wire, and the exterior layer circumscribing the interior layer, protective layer, and wire.

19. The method of claim 17 wherein said means for rotating said drive wheel of step (b) further comprises a reversible, variable speed drive means coupled to the drive wheel for rotating the drive wheel at various selectable speeds.

20. The method of claim 19 wherein the reversible, variable speed drive means comprises a hydrostatic drive motor.

21. The method of claim 17 wherein the means for biasing the hose against the drive wheel of step (b) comprises an idler wheel.

* * * * *